United States Patent [19]

Clark

[11] Patent Number: 4,844,167

[45] Date of Patent: Jul. 4, 1989

[54] THROUGH-TUBING PERFORATING APPARATUS

[75] Inventor: David A. Clark, Ponca City, Okla.

[73] Assignee: Conoco Inc., Ponca City, Okla.

[21] Appl. No.: 251,591

[22] Filed: Sep. 29, 1988

[51] Int. Cl.[4] ..... E21B 43/117; E21B 43/118

[52] U.S. Cl. ..... 175/4.53; 102/310; 102/321; 166/55.1; 175/4.6

[58] Field of Search ..... 175/4.6, 4.53; 166/55.1; 102/308, 310, 319, 321; 89/1.15

[56] References Cited

U.S. PATENT DOCUMENTS

| | | | |
|---|---|---|---|
| 2,543,814 | 3/1951 | Thompson et al. | 175/4.6 X |
| 2,664,158 | 12/1953 | McKean | 175/4.53 |
| 2,960,931 | 11/1960 | Douglass | 175/4.53 |
| 2,974,589 | 3/1961 | Bryan | 175/4.6 X |
| 3,016,014 | 1/1962 | Lebourg | 175/4.6 X |
| 3,067,679 | 12/1962 | Caldwell et al. | 175/4.6 X |

FOREIGN PATENT DOCUMENTS

| | | | |
|---|---|---|---|
| 1272604 | 8/1961 | France | 102/310 |

*Primary Examiner*—Hoang C. Dang

*Attorney, Agent, or Firm*—Richard K. Thomson

[57] ABSTRACT

A through-tubing perforating apparatus for use in improving wellbore production. A plurality of shaped charges are interconnected by rigid links that each have eyelets to receive the suspension wire. These links, in conjunction with a guide which initially engages and slides along the suspension wire, keep the shaped charges in a substantially uniform orientation generally perpendicular to the sides of the wellbore. Once the apparatus emerges from the production tubing, a releasable latch interconnecting an upper terminal connector to the supporting wire is actuated permitting the charges, under the influence of the rigid links, to slump under their own weight into contact with the casing walls. This provides maximum penetration into the formation upon actuation of the charges. The expended apparatus can be dropped into the bottom of the wellbore with the aid of a sinker bar.

12 Claims, 1 Drawing Sheet

THROUGH-TUBING PERFORATING APPARATUS

BACKGROUND AND SUMMARY OF THE INVENTION

The present invention is directed to apparatus for perforating a wellbore. More particularly, the present invention is directed to perforating apparatus that can be run in through the production tubing.

When perforating a wellbore, the use of an underbalanced technique (i.e., without the use of high density muds to control, or overbalance, the pressure of the wellbore fluids) has certain advantages. For example, when perforating is completed, the rush of produced fluids into the wellbore will clean out the newly formed perforations. In an overbalanced method, the combination of high density drilling fluid and surface pressure not only risks fracturing the reservoir, thereby permitting the trapped fluids to escape, but can also block off the perforations.

In the underbalanced perforating method, a packer and production tubing are run in the hole first to permit flow control of produced fluids. Accordingly, two types of underbalanced perforating apparatus are available: tubingconveyed perforating tools and through-tubing perforating tools. Through-tubing charges are necessarily small and, therefore, should be shaped to project maximum energy into the formation and efforts should be made to minimize dissipation of that energy. These efforts could include orienting the charges to fire laterally into the formation, not placing any superfluous structure between the charge and the formation, and placing the charge immediately proximate the casing wall. Some prior art perforating tools hold the through-tubing charges against one side of the borehole wall. However, such a perforating pattern known as 0° phasing can reduce produced fluids by as much as 10% when compared to 180° phasing (alternate charges actuatable into opposite sides of the formation).

The present tool allows 180° phasing with maximum formation penetration because the charges are pressed firmly against opposite sides of the borehole walls. Individual shaped charges are interconnected by rigid linkage means. The linkages are of such a length that twice the length of the charges extending beyond the connecting points plus the length of the linkage exceeds the diameter of the borehole causing the charges to be pressed firmly into contact with the wellbore. Longer linkage lengths may be used to reduce charge density. The configuration of the perforating apparatus is such that the maximum formation penetration possible will be achieved by projecting the full force of the charge in a direction perpendicular to the wall of the wellbore. Additional charges can be easily added as circumstances warrant. The expended charges can be released from the wireline and permitted to fall into the bottom of the wellbore (i.e., the rathole). A sinker bar can be used to assist in conveying the perforating apparatus through the production tubing and in assuring that the expended device falls into the rathole.

Other features, advantages and characteristics of the present invention will become apparent after a reading of the following detailed description.

DETAILED DESCRIPTION OF THE PREFERRED EMBODIMENT(S)

Figure 1:
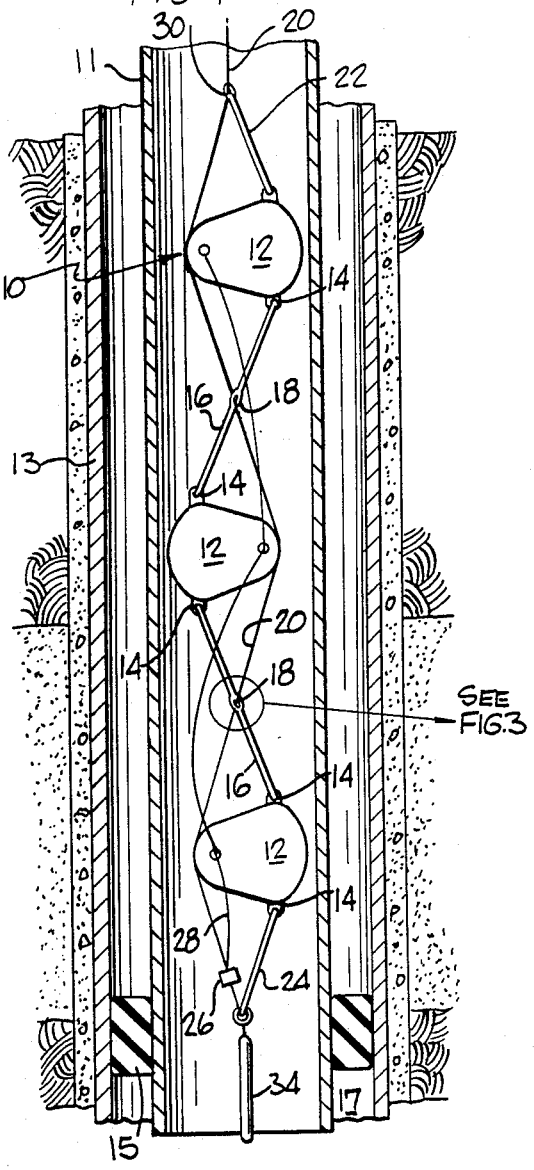
FIG. 1 is a schematic side view depicting the perforating apparatus of the present invention transiting the production tubing.
Figure 2:
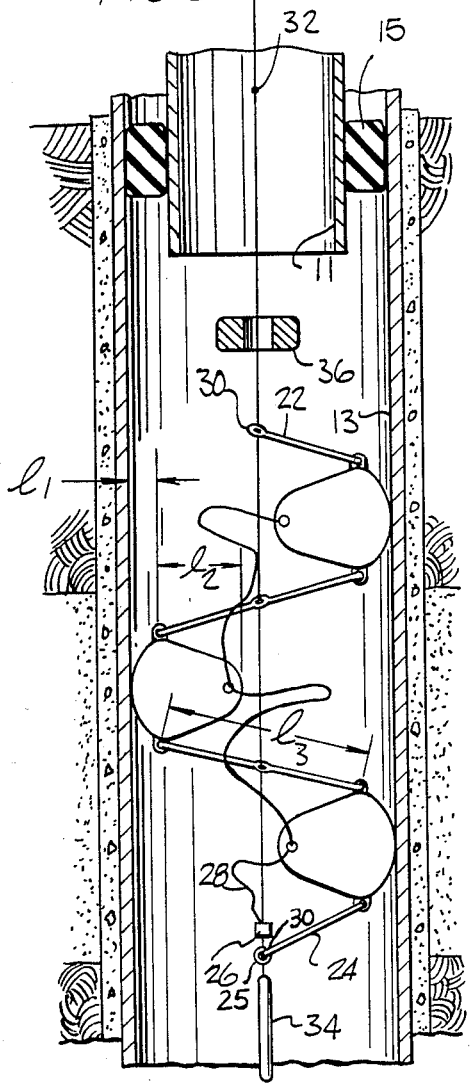
FIG. 2 is a schematic side view of the perforating apparatus shown in position below the production tubing.
Figure 3:
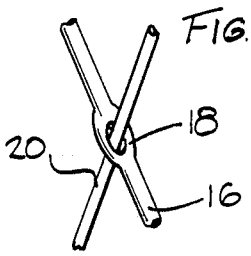
FIG. 3 is a detailed side view of the wireline and linkage member circled in FIG. 1.

The perforating apparatus of the present invention is shown FIG. 1 transiting production tubing 11 generally at 10. The lower end of production tubing 11 is secured in casing 13 using a conventional inflatable packer 15. By using packer 15, the lower end of tubing 11 is isolated in wellbore 17 and by the use of a blowout preventer stack and associated control valves (not shown) atop tubing 11, the influx of fluids into the wellbore following perforation can be satisfactorily controlled. Further, this initial influx will clean out the perforations of any loose sand, gravel, etc., created in the perforating process.

Perforating apparatus 10 comprises a plurality of shaped charges 12 each having a pair of connecting points (or ears) 14. These connecting points 14 divide the charge 12 laterally into a first length $l_1$, and a second length $l_2$. A substantially rigid linkage means 16 interconnects connecting points 14 of two adjacent charges 12. Linkages 16 each have a third length $l_3$. Each linkage means 16 preferably has an eyelet 18 that slidably receives suspension wire means 20. While suspension wire 20 may be the wireline itself, some advantages regarding preassembly attach to the use of a separate wire that can be attached to the end of the wireline using swaging, threaded connectors, or the like. Eyelets 18 help maintain a substantially uniform orientation of charges 23 to insure that the force of the explosion will be substantially perpendicular to the casing 13 (or wall of wellbore 17, if it is unlined). Although only three charges 12 are shown for ease of illustration, it will be understood that significantly more charges will be used for the typical perforating job.

The sum of the length $l_3$ of linkage means 16 and two charge lengths $l_1$ (i.e., the length of charges 12 which laterally augment the linkage 16) is at least somewhat greater than the diameter of casing 13. This ensures that the charges 12 are pressed firmly against the walls of casing 13 as the charges 12 slump downwardly under their own weight after emerging from tubing 11, yet cannot slump into contact with one another. The length $l_3$ of linkages 16 can be increased and controlled to produce the desired charge density for a particular wellbore perforation design. The combination of the lateral orientation of charges 12 and firmly pressing the charges against the sides of the wellbore, provides maximum penetration into the formation optimizing the lateral reach of the perforation operation.

Termination connector means 22 and 24 attach the uppermost and lowermost shaped charges 12 to wireline 20, respectively. Lower termination connector means 24 is fixed to wireline 20 as by a ring 25. A small explosive charge 26 can be attached to the wireline just above its connection to lower termination connector means 24. This charge can be actuated by the same Primacord high-speed fuse 28 that is used to detonate perforating charges 12. The Primacord 28 is set off by an electrical signal transmitted through wireline 20 to its place of connection thereto on charge 26. Upper termination connector 22 may have an eyelet 30 identical to those in linkage means 16. This eyelet 30 may slide freely along wireline 20. More preferably, however, eyelet 30 may be releasably attached to wireline 20 at 32 by latch means such as a shear pin or solder joint, or the like, so that the charges 12 cannot prematurely slump under their own weight and become lodged in tubing 11. Further, in this regard, sinker bar 34 can be attached to eyelet 30 of lower termination connector 24 by ring 25 to ensure (a) smooth transition through production tubing 11 and, (b) that the expended perforating tool 10 will fall into the bottom of wellbore 17. Latch means at 32 may be disengaged by a doughnut shaped weight 36 dropped down wireline 20.

Figure 4:
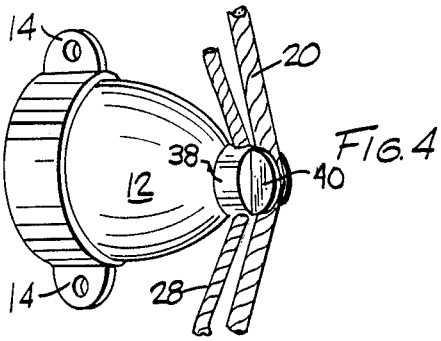
FIG. 4 is a enlarged side view of a particular preferred embodiment of a charge configuration.

One preferred embodiment depicting connection of charges 12 to the suspension wire 20 is shown in FIG. 4. Connecting ears 14 may be secured to charge 12 by a band which encirles it. The detonator cap 38 receives Primacord 28 and is also equipped with a slide guide 40 which slidingly engages suspension wire 20. Guides 40 keep charges 12 properly oriented with respect to wire 20 (and, hence, to casing 13) until the perforation tool 10 emerges from the bottom of tubing 11.

In use, the wellbore perforating apparatus 10 will be made up on the end of a wireline or upon a separate suspension wire means 20 that can subsequently be attached to the end of a wireline by conventional methods. The number of charges 12 will be selected to provide the desired number of perforations in casing 13. The length of linkage means 16 will be chosen to provide the desired charge density. For all cases, the length $l_3$ exceed the diameter of casing 13 less twice the charge length $l_1$ outside (i.e., away from the center of the wellbore 17) attachment points 14. The ends of linkage means 16 may be connected to attachment points 14 by rivets, a bend around loop, or the like, so as to permit relative pivotal motion in a single plane which bisects the wellbore 17. Linkage means 16 are preferably formed with eyelets 18 which sliding receive suspension wire means 20 so as to maintain the charges substantially orthogonal to the suspension wire means 20 and, therefore to wellbore casing 13. Termination connector means 22 and 24 are secured to the uppermost and lowermost attachment points 14 of the uppermost and lowermost charges 12, respectively. The opposite end of upper termination connector means 22 is threaded onto wire 20 and then fixed thereto by soldering, shear pins, or the like, such that the apparatus is stretched to provide a narrow profile that will readily slide through tubing 11. The eyelet 30 of lower termination connector means 24 is fixedly attached to suspension wire 20 and sinker bar 34 by a ring 25. Severing charge 26 is secured to wire 20 and the detonators of all charges 12 and 26 are interconnected by Primacord fuse 28.

Prior to lowering the perforating apparatus into wellbore 17, production tubing 11 will be run in with a conventional inflatable packer 15 to secure the lower end of tubing 11 in casing 13. The through-tubing perforating apparatus 10 of the present invention will be lowered into position using conventional wireline techniques. After the apparatus 10 emerges from tubing 11 and is positioned generally into the desired location, doughnut 36 can be dropped through tubing 11 impacting upper termination connector means 22 severing the solder joint or the like at 32. This allows charges 12 to slump under their own weight into secure contact with the interior of casing 13. An electrical impulse is transmitted from the surface through wireline 20 initially to severing charge 26 then to the other charges 12 through Primacord 28. As a practical matter, however, the signal is transmitted so rapidly through the Primacord 28 as to effectively simultaneously detonate all explosive charges 12 with severing charge 26.

Because of the intimate contact between charges 12 and casing 13 and the fact that the charges are positioned substantially orthogonally to casing 13, maximum penetration into the formation is achieved. Once the wire 20 is severed by charge 26, sinker bar 34 pulls the expended charges 12 and associated linkage means and hardware into the bottom of wellbore 17 (where doughnut 36 follows).

The present perforating apparatus provides a simple, inexpensive alternative that is flexible in its utility (i.e., as many charges as desired may be added simply and easily). Very little structure is actually dropped into the rathole and, what is, can easily collapse into a compacted heap.

Various changes, alternatives and modifications will become apparent to a person of ordinary skill in the art following a reading of the foregoing specification. For example, although a mechanical form of release is shown for the attachment at 32, another explosive charge could be employed and a separate isolated wire used to send an electrical signal from the surface to break the connection. It is intended that all such changes, alternative, and modifications as fall within the scope of the appended claims be considered part of the present invention.

I claim:

1. Apparatus for perforating a wall of a cylindrical wellbore of a given diameter after having passed through a tubing of a smaller diameter, said apparatus comprising:

(a) a plurality of shaped charges including an uppermost shaped charge and a lowermost shaped charge, each said shaped charge having a pair of diametrically opposed connecting means extending laterally therefrom, a line interconnecting said diametrically opposed connecting means defining a first length of said shaped charge which comprises the shortest distance between said line and a first outermost longitudinal point on said shaped charge and a second length of said shaped charge which is defined as the shortest distance from said line to a second innermost longitudinal point on said shaped charge;

(b) suspension wire means extending from a point above said uppermost shaped charge to a point beneath said lowermost shaped charge;

(c) separate individual linkage means extending between and pivotally attached to one of said connecting means of each of a pair of adjacent shaped charges, each said individual linkage means being substantially rigid and of a third length, the sum of twice said first length plus said third length being greater than said given wellbore diameter;

(d) termination connector means connecting said uppermost and said lowermost shaped charges to said suspension wire means at first and second termination connection points, the locations of said first and second termination connection points defining a first vertically extending length of said plurality of shaped charges, said uppermost termination connector means being capable of relative sliding motion with respect to said suspension wire means;

whereby, when said apparatus has passed through said smaller diametered tubing, said uppermost termination connector means can be allowed to slip down said suspension wire means to define a second lesser vertically extending length of said shaped charges and allowing said shaped charges to slump outwardly into contact with the wall of said wellbore by virtue of their own weight, said individual linkage means holding said shaped charges in direct contact with the wall of said wellbore.

2. The perforating apparatus of claim 1 wherein the length of said linkage means is significantly greater than necessary for the sum of twice said first length plus said third length to equal said wellbore diameter, thereby reducing shaped charge density.

3. The perforating apparatus of claim 1 wherein said individual linkage means interconnecting said shaped charges each have a first angular position when passing through said small diameter tubing and a second more severe angular position when said charges have emerged from said tubing, wherein a corresponding angular position of said shaped charges relative to each other when said linkage means are in said second angular position does not appreciably change from a corresponding angular position of said shaped charges relative to each other when said linkage means are in said first angular position.

4. The perforating apparatus of claim 1 wherein each linkage means includes an eyelet that slidably receives said suspension wire means.

5. The perforating apparatus of claim 4 wherein said suspension wire means is a conventional wireline by which said perforating apparatus is lowered into said wellbore.

6. The perforating apparatus of claim 1 further comprising a sinker bar attached to said lowermost termination connector means to facilitate passage of said perforating apparatus through said tubing.

7. The perforating apparatus of claim 1 further comprising latch means to releasably secure said uppermost termination connection means to said suspension wire means.

8. The perforating apparatus of claim 1 further comprising a length of primacord interconnecting said shaped charges.

9. The perforating apparatus of claim 1 further comprising means to release said shaped charges from said suspension wire means after they have been fired thereby allowing said charges and interconnecting linkage means to fall into the bottom of said wellbore.

10. The perforating apparatus of claim 1 wherein alternate ones of said shaped charges form a first group of charges that is 180° out of phase with a second group of charges.

11. The perforating apparatus of claim 1 further comprising means to releasably secure said uppermost slidable termination connector means to suspension wire means to stretch said perforating apparatus whereby said apparatus is provided with a sufficiently narrow profile to fit into said production tubing.

12. The perforating apparatus of claim 11 further comprising means to release said means to releasably secure said uppermost termination connector means.

* * * * *